US006447097B1

(12) United States Patent
Folkins et al.

(10) Patent No.: US 6,447,097 B1
(45) Date of Patent: Sep. 10, 2002

(54) ROW SCRAMBLING IN EJECTOR ARRAYS

(75) Inventors: Jeffrey J. Folkins, Rochester, NY (US); Richard N. Ellson, Palo Alto; Steven A. Buhler, Sunnyvale, both of CA (US); David A. Mantell, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/827,815

(22) Filed: Apr. 5, 2001

(51) Int. Cl.[7] ..... B41J 2/145
(52) U.S. Cl. ..... 347/40; 347/12
(58) Field of Search ..... 347/40, 41, 44, 347/46, 12, 13, 43

(56) References Cited

U.S. PATENT DOCUMENTS 4,415,909 A * 11/1983 Italiano et al. ..... 347/40
5,880,756 A * 3/1999 Ishii et al. ..... 347/40
6,099,108 A * 8/2000 Weber et al. ..... 347/40
6,257,690 B1 * 7/2001 Holstun ..... 347/12

* cited by examiner

*Primary Examiner*—Huan Tran
*Assistant Examiner*—Julian D. Huffman
(74) *Attorney, Agent, or Firm*—Fay, Sharpe, Fagan, Minnich & McKee, LLP

(57) ABSTRACT

An image forming system is provided having a printhead including a plurality of ejectors arranged in one or more sequenced groups. Each of the ejectors has a sequence number assigned thereto, ranging from a minimum value and incremented to a maximum value within each sequence group. The plurality of ejectors have an arrangement such that a difference between the sequence number assignment of any two adjacent ejectors is less than a difference between the maximum and minimum sequence number assignment values.

27 Claims, 5 Drawing Sheets

ROW SCRAMBLING IN EJECTOR ARRAYS

FIELD OF THE INVENTION

The invention relates to image forming systems, and more particularly relates to modifying the arrangement of ejector sites in printheads disposed within the image forming systems to result in a printhead less susceptible to minor non-uniformities, and misalignments.

BACKGROUND OF THE INVENTION

There are a number of different image forming technologies currently available for generating images on a print medium, such as a paper sheet. The electrostatic image forming system, being one type of image forming system, is generally known to those skilled in the art and is discussed herein as an exemplary image forming system. The electrostatic image forming system includes a printhead having a first electrode layer with a plurality of electrodes disposed on top of, and bonded with, a dielectric layer. The dielectric layer further couples to a second electrode layer. The second electrode layer also comprises a plurality of electrodes. One of the electrode layers most typically is a collection of RF-line electrodes, while the other of the electrode layers is most typically a collection of finger electrodes. The electrodes from the first electrode layer form intersections with the electrodes from the second electrode layer as viewed from a point in space generally orthogonal to the plane containing each of the electrode layers. However, the electrodes themselves are actually separated and electrically insulated from each other by at least one dielectric layer, or composition, as viewed from a cross sectional perspective of the printhead film containing the electrode and dielectric layers. The electrode intersections form charge generation sites, or ejectors, for emitting charges directed toward a dielectric image receiver in an image forming system. The final image forms by selectively toning the electrostatic latent image on the dielectric receiver and transferring the toned image to the print medium. The electrostatic image forming system is one example of an image forming system that can benefit from the teachings of the present invention.

Another exemplary type of image forming system is an acoustic ink printing system, is another one of the aforementioned types of image forming systems that can benefit from the teachings of the present invention. The acoustic ink printing system (AIP system) is an example of a system that employs focused acoustic energy to eject droplets of marking material, such as ink, from a printhead onto a printing medium. Printheads utilized in AIP systems most often include a plurality of droplet ejectors, each of which emits a converging acoustic beam into a pool of fluid, such as ink. The converging acoustic beam focuses at the interface between the ink and the air. The modulation of the radiation pressure exerted by the beam of each print ejector against the surface of the ink selectively ejects droplets of ink from the surface.

There is typically a collection, or grouping, of ejectors disposed on one or more printheads within the image forming systems described above, and in other image forming systems not specifically detailed herein. These ejectors can take the form of, e.g., charge generation sites, or ink ejectors.

AIP image forming systems typically utilize multiple rows of ejectors. A "row" of ejectors is the grouping of all ejectors within a printhead that lie on a straight line perpendicular to the printing direction. Generally each row (at least of a given ink color or ejectors) is offset in this perpendicular direction so that ejectors do not line up in the printing direction. They are typically equally spaced. For example, in the AIP system the rows are offset with a one pixel shift in each ejector row position relative to adjacent rows, to achieve full area coverage of a document when printing at 600 dpi resolution (see FIG. 4). If the AIP printhead is aligned and thus scans in a direction that is not perfectly perpendicular to the printing direction, then non-uniform gaps or overlaps can appear in the printouts at N-pixel intervals, where N is the number of rows of ejectors in the printhead. If all ejectors were in a single row then although the misalignment would have caused all printed image lines to be spaced with smaller gaps, these gaps would have been uniform and thus not objectionable. Anomalies in the addressing of the RF-drive signal used in powering the ink ejectors, or any other row to row ink pressure, flow, or dimensional non-uniformities in an AIP image forming system, can also allow spatial and electronic non-uniformity in the printhead to cause differences in the ink droplet volumes produced by ink ejectors in different rows of the printhead. The visual frequency response characteristics of the human eye is such that these periodic N-pixel interval defects, which often occur in the most sensitive portion of the eye frequency response region, can exacerbate these aforementioned effects, and result in perceptible defects in the resulting printed images.

One known approach that makes use of the visual frequency response characteristics of the human eye is a printhead having an interlacing of upper (1–4) and lower rows (5–8) in a counter-current flow printhead in order to push visual artifacts from thermal non-uniformity to a higher spatial frequency by interlacing the large drops produced in warm regions with the smaller drops from cold regions.

SUMMARY OF THE INVENTION

There exists in the art a need for an image forming system that contains one or more printheads having a modified ejector arrangement, which hinders the effects of any number of circumstances (e.g., temperature gradients, fluidic pressure drops, malaligned printheads and drive signal inconsistencies and defects, and manufacturing defects such as film thickness variations acoss the printhead). Additional defects not specifically mentioned that vary across the printhead can be responsible for such printing defects. The present invention is directed toward further solutions in this art.

An image forming system is provided having a printhead in accordance with one example embodiment of the present invention. The printhead includes a plurality of ejectors arranged in one or more sequenced groups. Each of the ejectors has a sequence number assigned thereto, ranging from a minimum value and incremented to a maximum value within each sequence group. The plurality of ejectors have an arrangement such that a difference between the sequence number assignment of any two adjacent ejectors is less than a difference between the maximum and minimum sequence number assignment values.

The phrase "sequence number" denotes a number assigned to each ejector in a group within a printhead. The ejectors are attributed to groups according to electrical connections (not shown), or addresses, and can be in any number of different combinations. Each sequential electrical connection, or address, to an ejector results in the ejector receiving the next "sequence number". Each group begins with a first electrical connection going to a first ejector having the sequence number "1". Then, for each electrically subsequent ejector in the group, the next sequential integer is assigned as that ejector's sequence number. The sequence number relates to the address by which the ejectors are identified electrically. The system, for example, can instruct various combinations of ejectors to emit ink, or a charge depending on the type of system. These instructions are implemented based on the sequence numbers. The system, for example, can instruct the "1", "3", "5", and "7" ejectors to emit ink at a predetermined time and location. Corresponding instructions issue in a like manner and in myriad of number variations. The example printhead detailed herein has eight ejectors in each group (and hence eight rows), thus the sequence numbers range from "1" to "8", however, the number of ejectors in each group, and therefore the corresponding sequence numbers can vary with different printhead designs.

The printhead, according to one aspect of the present invention, includes an arrangement of ejectors derived from a one-cycle sine wave pattern. The ejectors can be ink ejectors, charge ejectors, or the like. Each sequenced group, according to one embodiment, contains eight separate ejectors. The rows are in sequences where the maximum difference between sequence number assignments of any two adjacent ejectors in sequence of the one or more sequenced groups is two in the 1-cycle sine wave pattern (see FIG. 8).

The printhead, according to still another aspect of the present invention, has a predetermined arrangement of ejectors derived from a "3-cycle" wave pattern. The ejectors can be ink ejectors, charge ejectors, or the like. Each of the sequenced groups, according to one embodiment, contains eight separate ejectors. The maximum difference between the sequence number assignments of any two adjacent ejectors in sequence of the one or more sequenced groups is five in the 3-cycle sine wave pattern arrangement. The periodicity of the sequence numbers is three minima/maxima per grouping rather than one.

The pattern utilized in deriving the particular arrangement of ejectors can vary. The number of ejectors, in addition, can also vary beyond the eight ejectors described above and illustrated further below.

BRIEF DESCRIPTION OF THE DRAWINGS

The aforementioned features and advantages, and other features and aspects of the present invention, will become better understood with regard to the following description and accompanying drawings, wherein.

DETAILED DESCRIPTION OF THE INVENTION

Figure 4:
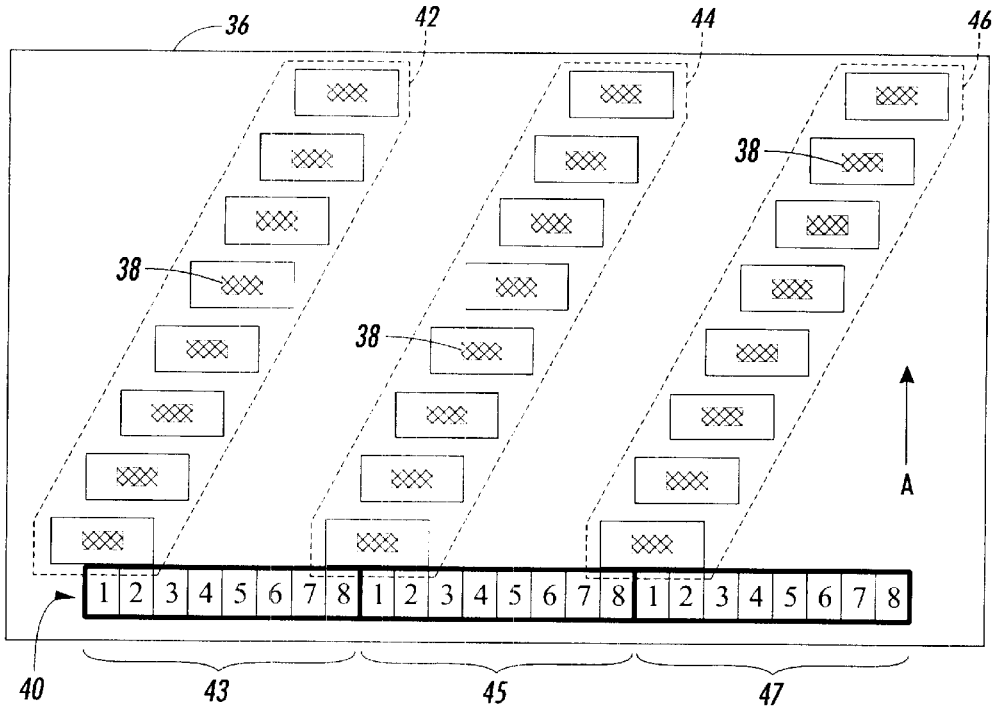
FIG. 4 is a schematic illustration of a face of the printhead.

The conventional acoustic ink image forming system printhead consecutively orders the positions of 8 rows of ejectors, shifting each ejector one pixel in each row, such that each consecutive pixel corresponds to the next row. Thus, cycling through 8 rows of ejectors results in a "saw-tooth" pattern with sequence numbers in the order of 1-2-3-4-5-6-7-8 as illustrated in FIG. 4. At least two undesirable variabilities exist with such an arrangement for ejectors within printheads. These variabilities are with the printhead angle and row-to-row printing non-uniformities.

The spatial positioning of the ejector rows on the acoustic ink image forming printhead, according to the teachings of the present invention, have a unique arrangement wherein the resultant printed image quality sensitivity to a slight printhead angle variation and printhead uniformity variations is minimal. The sequenced groups, or rows, of ejectors in the printhead are arranged in a non-intuitive, non-linear order minimizing the worst case positional differences between any two adjacent ejectors and pixels. A sequence group row ordering, in addition, can be used which causes any print defects to appear at visual frequencies higher than a base row frequency. This further reduces the visual perception of defects caused by printhead variations.

FIGS. 1–9, wherein like parts are designated by like reference numerals throughout, illustrate example embodiments of ejector arrays in image forming system printheads according to the teachings of the present invention. Although the present invention will be described with reference to the example embodiments illustrated in the figures, it should be understood that many alternative forms can embody the present invention. One of ordinary skill in the art will additionally appreciate different ways to alter the parameters of the embodiments disclosed, such as the size, shape, or type of elements and materials, in a manner still in keeping with the spirit and scope of the present invention.

Figure 1:
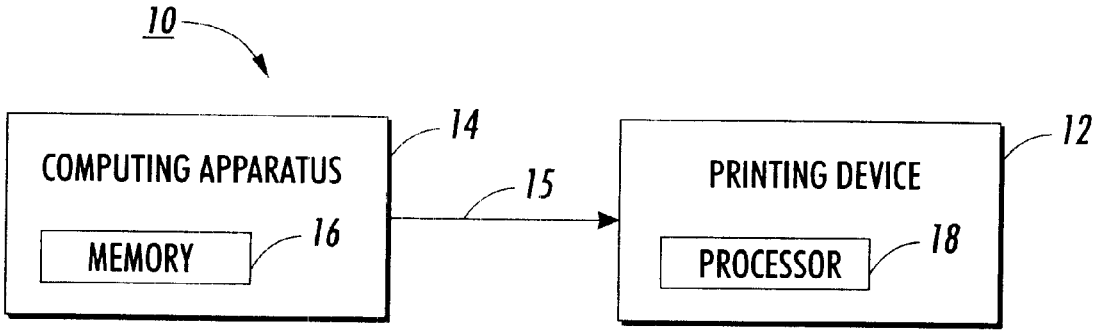
FIG. 1 is a schematic illustration of an image forming system according to the teachings of the present invention.

FIG. 1 illustrates a general image forming system 10 for printing an image or images. The phrase "image forming system" connotes an assemblage of different technologies, such as electrophotographic, electrostatic, electrostatographic, ionographic, acoustic, laser, ink jet (thermal, acoustic, piezo, or micromechanical) and other types of image forming or reproducing systems adapted to capture and/or store image data associated with a particular object, such as a document, and reproduce, form, or produce an image. Additional systems can include an LED array. One or more of the aforementioned image forming technologies can make use of the teachings of the present invention if they include use of separate emitters arranged in a 2-dimensional array.

The image forming system 10 includes a printing device 12, such as a printhead, and a computing apparatus 14. The phrase "computing apparatus" as used herein, refers to a programmable device that responds to a specific set of instructions in a well-defined manner, and can execute a set of instructions. The computing apparatus can include one or more of: a storage device, which enables the computing apparatus to store, at least temporarily, data, information, and programs (e.g., RAM or ROM); a mass storage device for substantially permanently storing data, information, and programs (e.g., disk drive or tape drive); an input device through which data and instructions enter the computing apparatus (e.g., keyboard, mouse, or stylus); an output device to display or produce results of computing actions (e.g., display screen, printer, or infrared, serial, or digital port); and a central processing unit including a processor for executing the specific set of instructions.

The computing apparatus 14 transmits the image data from the memory 16 to the printing device 12 to form an image. This transmission can occur through a link 15, such as an electric cable, fiber optic cable, or other wireless transmission arrangement such as infrared or RF signal. A processor 18 within the printhead device 12 processes the image to be printed.

This specification, from this point on, discusses issues and solutions in connection with the teachings of Applicants' invention using the basic framework and structure of an acoustic ink image forming system, the AIP image forming system. This focus on the AIP image forming system is by no means intended to limit the invention to such a specific image forming technology. The acoustic ink image forming system, rather, is discussed herein strictly for illustrative purposes, to allow elaboration on some more detailed points of image forming in connection with the teachings of the present invention.

Figure 2:
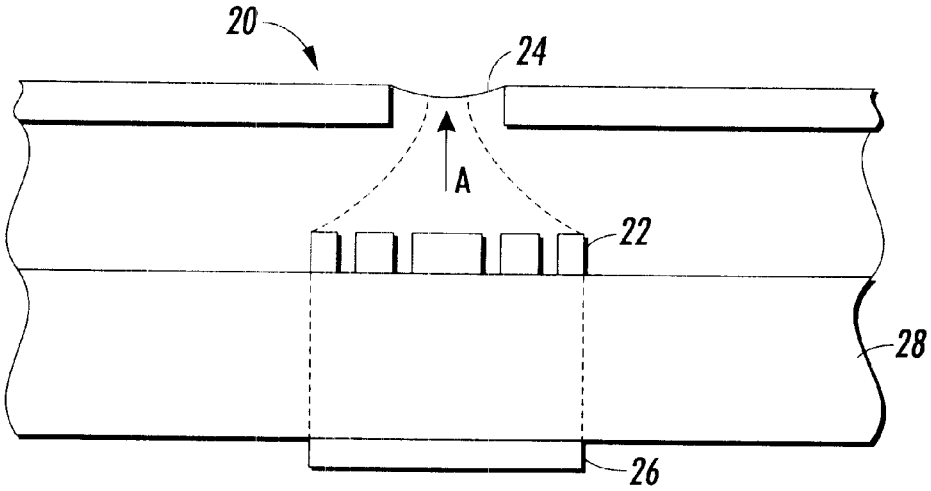
FIG. 2 is a diagrammatic cross-sectional illustration of a printhead within an image forming system according to one aspect of the present invention.
Figure 3:
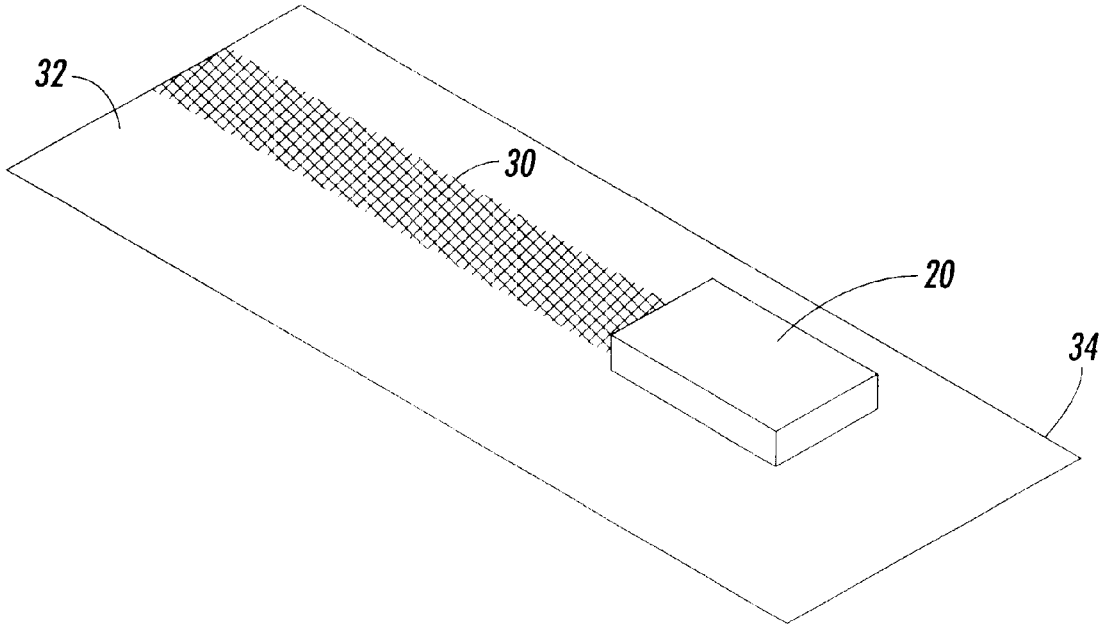
FIG. 3 is a perspective illustration of a functioning printhead according to one aspect of the present invention.

FIG. 2 illustrates a cross-sectional view of an AIP printhead 20. The AIP printhead 20 includes acoustic generators 22 for ejecting fluid, such as ink, from associated ink ejectors 24 as dictated by a signal generator 26. The AIP printhead 20 moves across respective swaths 30 and 32 of the printing medium 34 during a printing process as illustrated in FIG. 3. The printhead 20 moves across one of the swaths 30 and 32 in one direction, and returns across the same portion of the swath 30 or 32 in a second direction.

The AIP printhead 20, in one example illustration, ejects ink droplets of different colored ink as it proceeds through each pass along each swath 30 and 32.

FIG. 4 illustrates a more detailed view of a printhead face 36. The printhead face 36 includes a plurality of ejectors 38 arranged, in this illustration, in three generally diagonal groupings. Each ejector 38 has a sequence number 40 corresponding thereto. In a first ejector group 42, and first sequence group 43, there is a total of eight ejectors 38. Each ejector 38 has a corresponding sequence number 40 between "1" and "8". There is a one-pixel shift in each ejector row position relative to the adjacent rows, which in combination with the second ejector group 44 and third ejector group 46, results in full area coverage of the printing medium 34 on a swath by swath basis. The printhead moves in the direction of arrow A. This arrangement is a linear-based arrangement.

The first ejector 38 in the first ejector group 42 has a first sequence group 43 number of "1". Each subsequent ejector 38 in the first ejector group 42 has a corresponding sequence number 40 from the first sequence group 43, incrementing by one, and between the numbers "1" and "8" because there are eight ejectors 38 in the first ejector group 42. This is only one illustrative example of a known printhead face 36 arrangement. There can be any number (e.g., 16, 32, 64) of ejectors 38 in any one ejector group, generally offset from one another by one pixel. The number of ejectors within a group corresponds to the number of rows of ejectors on the printhead.

The illustrated printhead face 36 also includes a second ejector group 44 with corresponding second sequence group numbers 45, and a third ejector group 46 with corresponding third sequence group numbers 47. The ejectors in each ejector group 44, 46, and 48, arrange in a one-pixel shift per ejector row position relative to adjacent ejector rows. The sequence is the same and repeats for each ejector group.

Figure 5:
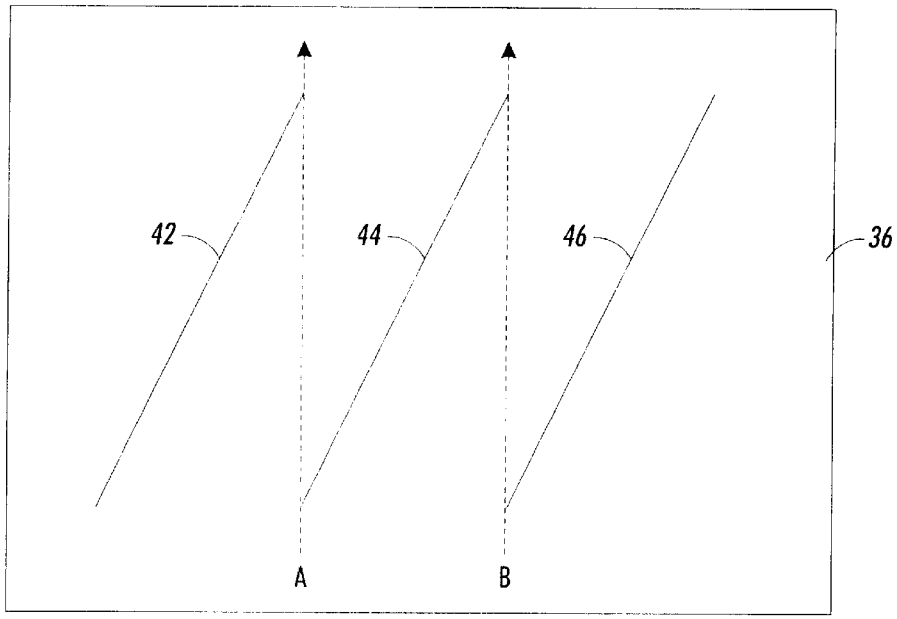
FIGS. 5, 6 and 7 are diagrammatic illustrations of the ejectors of FIG. 4 in various arrangements.

FIG. 5 illustrates a perfectly aligned printhead face 36 with respect to a scan direction corresponding to scan border arrows A and B, which are perpendicular to the rows of the ejectors 38 on the printhead face 36. The scan borders A and B are the borders between ejectors 38 of each ejector group 42, 44, 46, and 48. Each of the ejector groups 42, 44, and 46 from FIG. 4 are shown in a simplified representation in FIG. 5 as well. The scanned path borders A and B, as can be seen, are reachable by both an upper end of the first ejector group 42 and a lower end of the second ejector group 44. The scanned path borders A and B represent the approximate width of one pixel. In other words, there is a one pixel space in a horizontal direction in the figure between the top ejector of ejector group 42 and the bottom ejector of ejector group 44, likewise with group 44 and group 46. This appropriately aligned arrangement enables the ejectors disposed within each group to eject ink in pixel locations along the scan path borders A and B in addition to the more central portions of the ejector groups 42, 44, 46, and 48.

Figure 6:
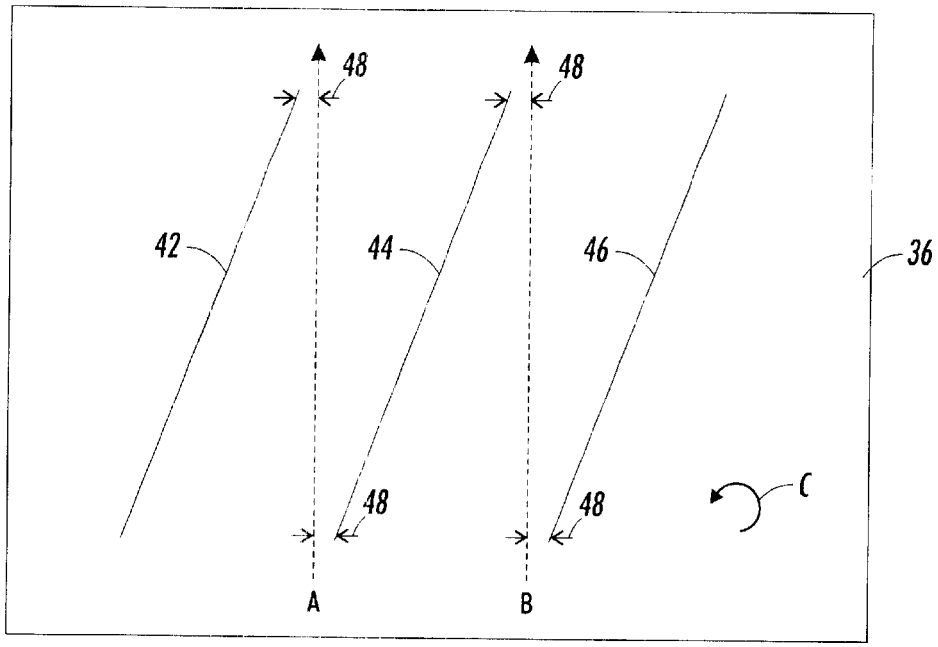

FIG. 6, however, illustrates a scenario wherein the printhead face 36 is rotated slightly in the counterclockwise direction (arrow C) relative to the scan path borders A and B. This illustration again shows the first, second, and third ejector groups 42, 44, and 46, respectively. The result in this instance is that the slight rotation of the printhead face 36 causes the uppermost ejectors 38 in the first ejector group 42, and the lowermost ejectors 38 in the second ejector group 44, to be unable to reach the scan path border A. Likewise, the uppermost ejectors 38 in the second ejector group 44, and the lower most ejectors 38 in the third ejector group 46, are unable to reach the scan path border B. The difference between the uppermost ejectors 38 and lowermost ejectors 38 of each group is greater than one pixel and is represented by the gap 48. Therefore, any corresponding pixels along the path borders A and B do not receive ink from the ejectors 38. This results in non-uniform pixel column spacing during use.

The pixel column spacing errors are proportional to the difference in rows between two pixels. In other words, there is an equal distance between each of the ejectors, thus an equal distance between each of the resulting pixels, except for the distance between the last ejector of each group 42, 44, and 46 and the first ejector of an adjacent group 42, 44, and 46. If there is an error in the spacing, caused by the rotation of the printhead face 36, or the like, that error will be translated equally to the distance between each ejector. However, the error is greatly magnified between the last ejector of each group 42, 44, and 46, and the first ejector of each adjacent group 42, 44, and 46. To look at the scenario from still one more perspective, the "sawtooth" pixel 1-2, 2-3 . . . 7-8 spacings are all the same, but the 8-1 spacing corresponding to the transition between two adjacent ejector groups 42, 44, and 46, is seven times greater. This single large spacing variability, in the example counterclockwise rotation variation of the printhead face 36, results in magnified and objectionable defects in the printed image, such as a white line with an eight pixel column frequency, or streak frequency. This is the conventional design currently in use for many ejector-based printheads.

Figure 7:
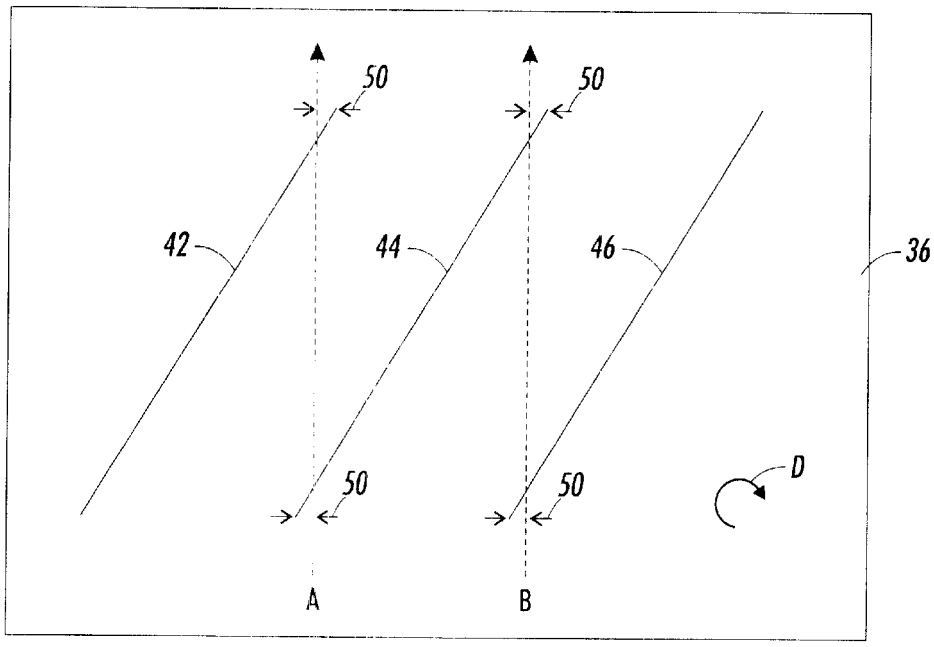

FIG. 7 illustrates a different result originating with the conventional printhead face "sawtooth" arrangement. The printhead face 36, in this instance, has been rotated slightly in the clockwise direction (arrow D), thus causing the uppermost ejectors 38 in the first ejector group 42 and the lowermost ejectors 38 in the second ejector group 44 to overlap 50 along the scan path border A. A corresponding overlap 50 occurs at the uppermost ejector 38 of the second ejector group 44 and the lowermost ejector 38 of the third ejector group 46 with respect to the scan path border B. The overlap 50 represents a spacing of less than one pixel between these uppermost and lowermost ejectors 38. The printing defect that results from this slight clockwise rotation variation is a heavier, or bolded, line occurring once every eight pixels, i.e., the same frequency as the white line resulting from the variation depicted in FIG. 6.

The particular rotation (clockwise or counterclockwise) as detailed above relates only to the particular examples illustrated and is intended to illustrate example ways in which a printhead can become misaligned, and some possible resulting effects of such misalignment. The printhead and/or individual ejectors, for example, can become misaligned along many different axes and in many different ways. The printhead of the present invention addresses the printing defects that can result from such misalignments.

The human visual system varies with each person. The human visual system is especially perceptive of periodic structure or patterns. The human eye is highly sensitive to approximately the 0.3 to 3-cycle per millimeter period occurring in any pattern. Patterns with frequencies generally either greater than this or lower than this have decreasing visual perceptibility and hence, it is less likely the human visual system can notice the pattern or defect.

With a pixel spacing of 600 ejectors per inch the 8 pixel "sawtooth" pattern described in FIGS. 4–7 has only a single minima/maxima of the sequence numbers per grouping and can produce a periodic defect frequency within the objectionable 0.3 to 3 cycle per millimeter range if any printhead non-uniformity correlates with sequence number.

The printhead of the present invention employs a repeating non-linear pattern for the arrangement of the ejectors, rather than the repeating linear "sawtooth" arrangement known in the art. The use of a repeating non-linear pattern, in varying combinations and patterns, addresses the gap and the overlap issues associated with the "sawtooth" arrangement by reducing the sequence number difference between adjacent ejectors. The reduction of the sequence number difference correspondingly reduces the occurrence of gaps and overlaps as will be further detailed herein.

The printhead according to one aspect of the present invention employs a repeating non-linear pattern for the arrangement of ejectors such that there are more than one minima/maxima of sequence numbers per grouping. By increasing the number of minima/maximas of the sequence numbers per grouping a printhead with, e.g., three such cycles, 600 ejectors per inch, and 8 pixels per pattern generates defects closer to 9 cycles per millimeter and thus significantly outside of the most sensitive objectionable portion of the human visual perception range.

Two primary factors according to aspects of the present invention, in summary, are the minimization of the worst case sequence number difference between adjacent ejectors, and the increase of the spatial frequency above once per cycle of the defect repetition pattern.

Figure 8:
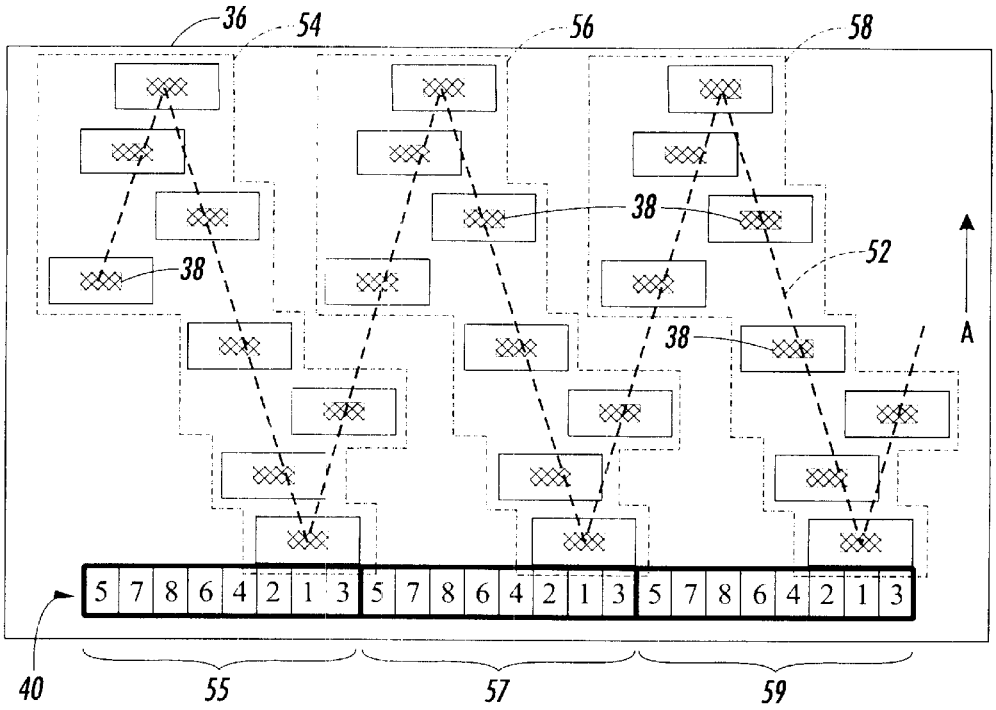
FIG. 8 is a diagrammatic illustration of ejectors according to the teachings of the present invention.

FIG. 8 illustrates a printhead face 36 in accordance with the teachings of the present invention. This arrangement minimizes the worst case sequence number difference between adjacent ejectors. For example, as illustrated in FIG. 4, the largest number difference (worst case) between adjacent ejectors is seven. Each ejector 38 in FIG. 8, rather than being arranged in a "sawtooth" arrangement, is instead arranged in approximate compliance with the non-linear arrangement of a 1-cycle sine wave. The sequence, found in the sequence numbers 40, remains the same for each ejector 38; however, the position of each ejector 38 varies in accordance with the 1-cycle sine wave. In other words, the ejector 38 with the corresponding sequence number of "1" was in the lowermost, and left-most, position of the original "sawtooth" arrangement of FIG. 4. The ejector 38 with the corresponding sequence number "1" in the present arrangement is still in the lowermost row position, but is no longer in the left-most position. Each of the ejectors 38 in the ejector groups 54, 56, and 58 have a different arrangement as illustrated by the sequence number groups 55, 57, and 59. For example, the printhead has a first ejector group 54 with corresponding first sequence group numbers 55, a second ejector group 56 with corresponding second sequence group numbers 57, and a third ejector group 58 with corresponding third sequence group numbers 59.

Rather than following the previous 1-2-3-4-5-6-7-8 "sawtooth" linear sequence, the sequence of the printhead of the present invention is a non-linear 1-cycle wave arrangement is 5-7-8-6-4-2-1-3. It is 1-cycle because there is only a single minima/maxima of the pattern per sequence. This ejector arrangement results in the difference between each sequence number 40 of adjacent ejectors 38 not exceeding a value of two. Specifically, the maximum difference between the sequence numbers of any two adjacent ejectors 38 is two. A difference in sequence numbers of two corresponds to a single ejector 38 between the two ejectors 38 from which the difference is calculated. For example, between the values "5" and "7", the 5-7 portion, there is only one ejector 38 that sequentially belongs between the first two ejectors 38 of the first ejector group 54. The one ejector 38 has the sequence number of "6". Later in the sequence, between the ejectors 38 with the sequence numbers "7" and "8", or "2" and "1", (the 7-8 and 2-1 portions respectively) there are no ejectors 38 having sequence numbers between these ejectors, thus their difference is one. The "sawtooth" arrangement has a difference between each sequence number of one within the sequence group and a difference of seven between sequence groups.

As can be seen, if the printhead face 36 illustrated in FIG. 8 rotates in the clockwise or counterclockwise directions equivalent rotational distances to the distances of the printhead faces illustrated in FIG. 6 and FIG. 7, a lesser gap 48 or overlap 50 forms. There is a greater distance, according to sequence number, between adjacent ejectors 38, but the maximum difference within any one group 54, 56, and 58 is two, including the difference between adjacent ejectors 38 of each group 54, 56, and 58, which is a 3-5 transition. Again, in the "sawtooth" arrangement there is a difference of seven ejectors between the ejectors corresponding to sequence numbers "1" and "8", which represent the transition between each ejector group 42, 44, and 46.

Figure 9:
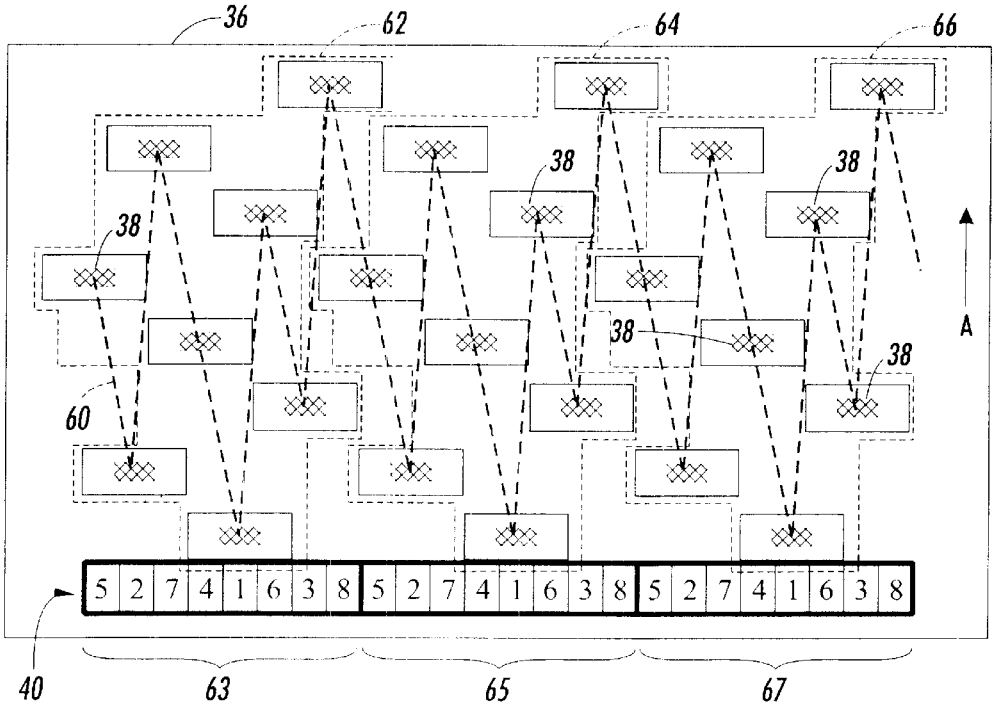
FIG. 9 is a diagrammatic illustration of the ejectors according to still another aspect of the present invention.

FIG. 9 illustrates still another variation according to the teachings of the present invention. This arrangement reduces the worst case sequence number difference between adjacent ejector groups, while also increasing the spatial frequency of the arrangement pattern. Both of these factors contribute to the overall perception of defects in a printed medium by the human eye.

In FIG. 9, a first ejector group 62 corresponds to the first sequence group numbers 63, a second ejector group 64 corresponds to the second sequence group numbers 65, and a third ejector group 66 corresponds to the third sequence group numbers 67. Each of the ejectors 38 in each ejector group is arranged along a 3-cycle curve 60, i.e., with three minima/maximas per group. This arrangement slightly increases the distance between sequence numbers of adjacent ejectors 38 relative to the 1-cycle arrangement of FIG. 8. However, the greatest difference between any two adjacent ejectors 38, according to sequence numbers, is five, with a majority of differences equaling three. Moreover, the difference between adjacent ejector groups is also three (e.g., 8-5), which is less than the difference of adjacent ejector groups in conventional "sawtooth" arrangements as previously described.

The 3-cycle arrangement illustrated in FIG. 9 has the advantage that any variability in printing uniformity between rows (e.g., plate skew or bow, ink flow variations, correlated row power variations, alignment deficiencies, and the like) print at a visual streak frequency of 600/8/3 cycles per inch, or about 9 cycles/mm. This is relative to the 1-cycle arrangement with a visual streak frequency of 600/8 cycles per inch, or 3 cycles/mm. The human eye's visual perception frequency response between 3 cycles/mm and 9 cycles/mm is relatively steep, with the 9 cycles/mm value offering a super-linear improvement in imperceptibility, or the lack of the eye's ability to visually perceive the defects. This results in the 3-cycle arrangement having considerable relative tolerance for printing non-uniformities, defects, and the like.

The factors taken into consideration by the teachings of the present invention are the reduction of the worst case row differential and/or simultaneously increasing the resulting streak frequency, or increasing the streak frequency to three or more cycles per pattern repeat. A simple design guideline for creating pattern which increases the streak frequency to Z cycles when the desired Z value has no common factors with the number of rows (i.e. ejectors per grouping) N, is the formula: Pattern[R]=1+((Pattern[1]−1+(R−1)Z) modulo N), where R is the row variable starting at one and Pattern[1] is the desired starting value. If Z is less than N/2 then this produces Z cycles. An alternate design guideline is simply to map out a sine wave and chose the nearest unique integer values.

The teachings of the present invention relate to arranging the ejectors within a printhead work for a variety of printhead types, including printheads having different numbers of rows, non-straight rows, non-row types (e.g, individually addressed pixels), and the like. Additionally, other array printing technologies, such as thermal inkjet, can also benefit from these design techniques. Further, as previously mentioned, the pattern of the ejectors is non-linear but need not be sinusoidal.

The resulting arrangement as disclosed herein, balances the minimization of the worst case row difference between consecutive pixel columns and the shift row mapping pattern to a higher spatial frequency than once per sequence variable in an effort to arrive at a period of defect repetition or frequency that is below that of the normal human eye visual perception frequency. The visual perception frequency varies with each individual, but the higher the frequency, the less perceptible the defect. The less perceptible the defect frequency, the more desirable the ejector arrangement.

Numerous modifications and alternative embodiments of the invention will be apparent to those skilled in the art in view of the foregoing description. This description, accordingly, is to be construed as illustrative only and is for the purpose of teaching those skilled in the art the best mode for carrying out the invention. Details of the structure may vary substantially without departing from the spirit of the invention, and exclusive use of all modifications that come within the scope of the appended claims is reserved. It is intended that the invention be limited only to the extent required by the appended claims and the applicable rules of law.

What is claimed is:

1. In an image forming system, a printhead, comprising:

a plurality of ejectors non-uniformly spaced and arranged in one or more non-linear sequenced groups, each of said ejectors having a sequence number assignment ranging from a minimum value to a maximum value within each said sequence group;

said plurality of ejectors arranged such that a difference between said sequence number assignment of every two adjacent ejectors is less than a difference between said maximum value and said minimum value.

2. The printhead according to claim 1, wherein said ejectors in each of said one or more non-linear sequenced groups are arranged to form a one-cycle sine wave pattern.

3. The printhead according to claim 2, wherein said difference between said adjacent ejectors in said one or more non-linear sequenced groups is greater than one.

4. The printhead according to claim 2, wherein at least one of a minima and a maxima of pattern groupings is two or greater.

5. The printhead according to claim 4, wherein said plurality of ejectors in said one or more non-linear sequenced groups are arranged in a multicycled pattern such that a resulting pattern has a spatial frequency when printed of greater than three cycles per milimeter.

6. The printhead according to claim 1, wherein each non-linear sequenced group comprises eight ejectors.

7. The printhead according to claim 6, wherein a maximum difference between sequence number assignments of any two adjacent ejectors in said one or more non-linear sequenced groups is two.

8. The printhead according to claim 1, wherein said plurality of ejectors in said one or more non-linear sequenced groups are arranged to form a three-cycle pattern.

9. The printhead according to claim 8, wherein each of said sequenced groups comprises eight ejectors.

10. The printhead according to claim 8, wherein a maximum difference between sequence number assignments of any two adjacent ejectors of said one or more sequenced groups is five.

11. A printhead, comprising:

a plurality of non-uniformly spaced ejectors disposed in a predetermined non-linear arrangement that reduces a difference between sequence number assignments of an end ejector of a first sequenced group and a beginning ejector of a second sequenced group to a value less than a difference between a maximum sequence number assignment and a minimum sequence number assignment.

12. The printhead according to claim 11, wherein said predetermined arrangement of ejectors forms a one-cycle sine wave.

13. The printhead according to claim 11, wherein said ejectors comprise one of charge and ink ejectors.

14. The printhead according to claim 11, wherein each of said sequenced groups contains eight ejectors.

15. The printhead according to claim 14, wherein a maximum difference between sequence number assignments of any two adjacent ejectors of said one or more sequenced groups is two.

16. The printhead according to claim 11, wherein said predetermined arrangement is derived from a three-cycle pattern.

17. The printhead according to claim 16, wherein said ejectors comprise one of charge and ink ejectors.

18. The printhead according to claim 16, wherein each of said sequenced groups contains eight ejectors.

19. The printhead according to claim 18, wherein a maximum difference between sequence number assignments of any two adjacent ejectors of said one or more sequenced groups is five.

20. The printhead according to claim 11, wherein said plurality of ejectors in said one or more non-linear sequenced groups are arranged in a multicycled pattern such that the resulting pattern has a spatial frequency when printed of greater than 3.0 cycles per millimeter.

21. A method of arranging ejectors in a printhead of an image forming system, comprising the steps of:

assigning a sequence number to each of a plurality of ejectors in one or more groups; and arranging each of said plurality of ejectors in at least one of said sequenced groups on a printhead in a non-linear and non-uniformly spaced manner such that a difference between said sequence number assignment of every two adjacent ejectors is less than a difference between a maximum sequence number assignment value and a minimum sequence number assignment value.

22. The method according to claim 21, further comprising the step of arranging said plurality of ejectors in each said sequenced groups in a generally one-cycle sine wave pattern.

23. The printhead according to claim 22, wherein said difference between said adjacent ejectors in said one or more non-linear sequenced groups is greater than one.

24. The printhead according to claim 22, wherein a maximum difference between sequence number assignments of any two adjacent ejectors in said one or more non-linear sequenced groups is two.

25. The method according to claim 21, wherein said arranging step comprises disposing each of said plurality of ejectors in a generally three-cycle sine wave pattern.

26. The printhead according to claim 25, wherein said difference between said adjacent ejectors in said non-linear sequenced groups is greater than one.

27. The printhead according to claim 25, wherein a maximum difference between sequence number assignments of any two adjacent ejectors of said one or more sequenced groups is five.

* * * * *